United States Patent [19]

Kounnas

[11] Patent Number: 4,825,885

[45] Date of Patent: May 2, 1989

[54] CIGARETTE HAVING CIRCUMFERENTIAL GROOVES IN THE TOBACCO ROD

[75] Inventor: Christopher N. Kounnas, Louisville, Ky.

[73] Assignee: Brown & Williamson Tobacco Corporation, Louisville, Ky.

[21] Appl. No.: 160,428

[22] Filed: Feb. 25, 1988

[51] Int. Cl.[4] ..... A24D 1/02
[52] U.S. Cl. ..... 131/365; 131/360
[58] Field of Search ..... 131/360, 365

[56] References Cited

U.S. PATENT DOCUMENTS

Re. 32,615 3/1988 Luke ..... 131/360
1,555,320 4/1925 Weil ..... 131/365

FOREIGN PATENT DOCUMENTS 0188091 7/1907 Fed. Rep. of Germany ..... 131/36

*Primary Examiner*—V. Millin
*Attorney, Agent, or Firm*—Charles G. Lamb

[57] ABSTRACT

A cigarette having a tobacco rod circumscribed by a combustible wrapper. The wrapped tobacco rod includes a plurality of circumferential grooves embedded in the wrapper and underlying tobacco rod.

7 Claims, 2 Drawing Sheets

CIGARETTE HAVING CIRCUMFERENTIAL GROOVES IN THE TOBACCO ROD

BACKGROUND OF THE INVENTION

The present invention relates to smoking articles, and more particularly to cigarettes.

Conventional cigarettes are formed with generally cylindrical tobacco columns. The term cylindrical as used herein means tobacco columns which are either circular or oval in transverse cross-section. Conventional tobacco columns have a constant circumference, that is, they are substantially uniform in circumference along the entire length of the tobacco column without any discontinuity in the circumference.

SUMMARY OF THE INVENTION

The present invention provides a cigarette tobacco column comprising a rod of tobacco, a wrapper of combustible material circumscribing the tobacco rod, and a plurality of circumferential grooves embedded in the wrapper and underlying tobacco rod, the circumferential grooves being spaced apart from each other along the length of the wrapped tobacco rod.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENTS

Figure 1:
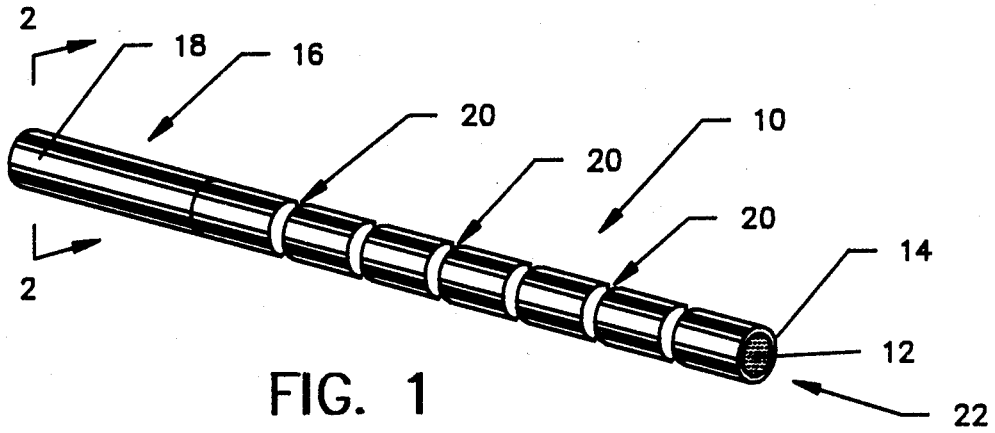
FIG. 1 is a perspective view of a cigarette including features of the present invention.
Figure 2:
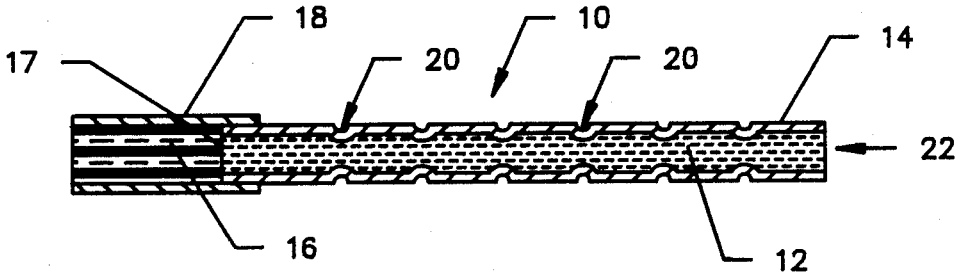
FIG. 2 is a longitudinal cross-section of the cigarette of FIG. 1 as seen in the direction of arrows 2—2.

With reference to FIGS. 1 and 2, there is shown a cigarette, generally denoted as the numeral 10, comprising a generally cylindrical rod of tobacco 12 circumscribed by a wrapper 14 of combustible paper material. A smoke filter 16 is positioned in abutting relationship to the mouth end 17 of the tobacco rod 12 and is attached thereto by tipping material 18 which circumscribes the filter 16 and circumferentially overlays the wrapped tobacco rod at the end portion thereof adjacent the filter 16.

With continued reference to FIGS. 1 and 2, a plurality of circumferential grooves 20 is embedded in the wrapper 14 and underlying tobacco rod 12. The circumferential grooves 20 are spaced apart from each other at uniform intervals along the length of the wrapped tobacco column.

Figure 3:
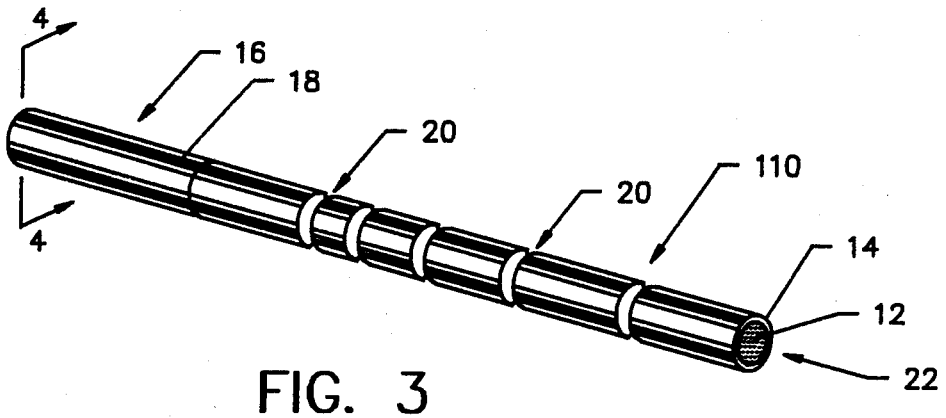
FIG. 3 is a perspective view of another cigarette including features of the present invention.
Figure 4:
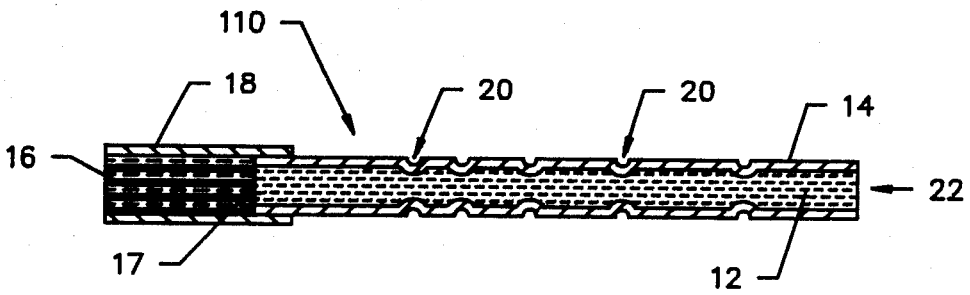
FIG. 4 is a longitudinal cross-section of the cigarette of FIG. 3 as seen in the direction of arrows 4—4.

Now with reference to FIGS. 3 and 4, there is shown a cigarette 110 which is essentially identical to the cigarette 10 of FIGS. 1 and 2 except for the spacing of the grooves 20. Therefore, identical numerals are used to denote the common components and the description of the cigarette will not be repeated. In the cigarette 110, the grooves 20 are not uniformly spaced apart along the wrapped tobacco rod 12. As shown, the space between adjacent grooves 20 along the length of the tobacco column decreases progressing from the end 22 of the tobacco rod 12 which will be ignited toward the filter or mouth end 17.

With reference to FIGS. 1–4, the zones of the tobacco rod 12 circumscribed by the grooves 20 have a greater density than do the zones of the tobacco rod 12 between adjacent grooves 20. The grooves 20 provide a decreased burn rate due to the higher density tobacco. The grooves 20 are preferably at least 1 mm deep as measured from the periphery of the wrapped tobacco rod. In one advantageous embodiment, the circumference of the tobacco rod between adjacent grooves 20 is 17 mm and the tobacco rod circumscribed by the grooves 20 is 10 mm.

Figure 5:
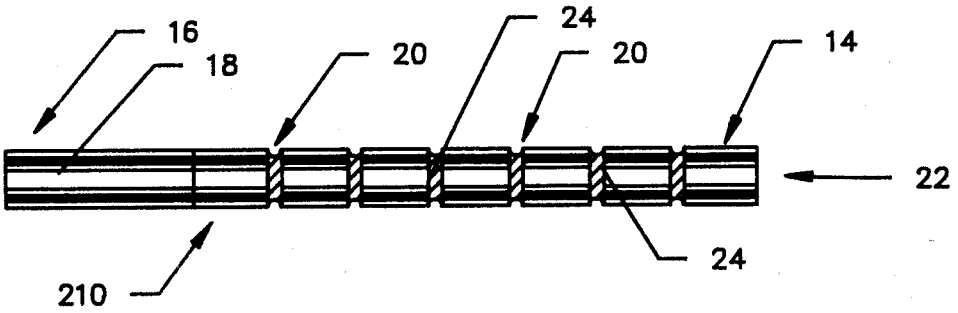
FIG. 5 is a side view of a cigarette similar to that of FIG. 1 with an additional feature; and, FIG. 6 is a side view of a cigarette similar to that of FIG. 3 with an additional feature.

With reference to FIG. 5, there is shown a cigarette 210 which is essentially identical to the cigarette 10 of FIGS. 1–2 with the added feature of a flavorant material 24 included in the circumferential grooves 20. The flavorant material 24 can be, for example, vanillin including virtually any flavor such as, for example, menthol, evergreen, cherry and the like which a smoker may find pleasant. The flavorant material 24 can be impressed into the portions of the wrapper 14 embedded to form the grooves 20, or may be deposited into the grooves 20 to at least partially fill the grooves 20.

Figure 6:
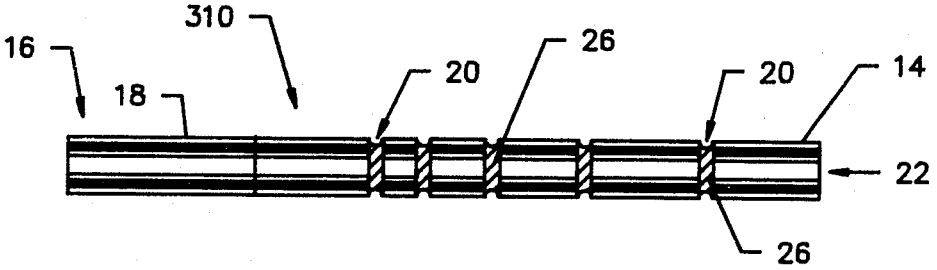

With reference to FIG. 6, there is shown a cigarette 310 which is essentially identical to the cigarette 110 of FIGS. 3–4 with the added feature of a coal retardant material 26 included in the circumferential grooves 20. The retardant material 26 can be, for example, magnesium hydroxide. The retardant material can be impressed into the portions of the wrapper 14 embedded to form the grooves 20, or may be deposited into the grooves 20 to at least partially fill the grooves 20.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A cigarette comprising:

a rod of tobacco;

a wrapper of combustible material circumscribing the tobacco rod;

a plurality of circumferential grooves embedded in the wrapper and underlying tobacco rod, the circumferential grooves being spaced apart from each other along the entire length of the wrapped tobacco rod; and the tobacco of the tobacco rod circumscribed by the circumferential grooves has a greater density than does the tobacco of the tobacco rod between adjacent grooves so that the zones of the tobacco rod circumscribed by the grooves have a slower burn rate than the zones of the tobacco rod between adjacent grooves.

2. The cigarette of claim 1, further comprising a burning coal retardant material in the circumferential grooves.

3. The cigarette of claim 1, further comprising a flavorant material in the circumferential grooves.

4. The cigarette of claim 1, wherein each of the circumferential grooves is at least approximately 1 mm deep as measured from the periphery of the wrapped tobacco rod.

5. The cigarette of claim 5, wherein the circumference of the wrapped tobacco rod is approximately 17 mm and the circumference of the wrapped tobacco rod in the grooves is no greater than 10 mm.

6. The cigarette of claim 1, further comprising:

a tobacco smoke filter at one end of the tobacco rod; and, tipping material circumscribing the filter and circumferentially overlaying the wrapped tobacco rod at the end thereof adjacent the filter.

7. A cigarette comprising:

a rod of tobacco;

a wrapper of combustible material circumscribing the tobacco rod;

a tobacco smoke filter at one end of the rod of tobacco; and, a plurality of circumferential grooves embedded in the wrapper and underlying tobacco rod and the tobacco of the tobacco rod circumscribed by the circumferential grooves has a greater density than does the tobacco of the tobacco rod between adjacent grooves, the circumferential grooves being spaced apart from each other along the length of the wrapped tobacco rod, the space between adjacent grooves decreases progressing from the end of the tobacco rod which will be ignited toward the end of the tobacco rod having the smoke filter, and the tobacco of the tobacco rod circumscribed by the circumferential grooves has a greater density than does the tobacco of the tobacco rod between adjacent grooves so that the zones of the tobacco rod circumscribed by the grooves have a slower burn rate that the zones of the tobacco rod between adjacent grooves.

* * * * *

UNITED STATES PATENT AND TRADEMARK OFFICE

CERTIFICATE OF CORRECTION

PATENT NO. : 4,825,885

DATED : May 2, 1989

INVENTOR(S) : Christopher N. Kounnas

It is certified that error appears in the above—identified patent and that said Letters Patent is hereby corrected as shown below:

In claim 2, line 63, after "material" insert ---only---; and, claim 5, line 3, delete "5" and insert in place thereof ---4---.

Signed and Sealed this

Nineteenth Day of September, 1989

*Attest:*

DONALD J. QUIGG

*Attesting Officer*

*Commissioner of Patents and Trademarks*